United States Patent [19]

Sandvik

[11] Patent Number: 4,577,810

[45] Date of Patent: Mar. 25, 1986

[54] FEED DEVICE FOR GUIDING A ROPE ONTO A WINDING DRUM

[75] Inventor: Johannes Sandvik, Stokke, Norway

[73] Assignee: Elkem A/S, Oslo, Norway

[21] Appl. No.: 652,177

[22] Filed: Sep. 18, 1984

[30] Foreign Application Priority Data

Sep. 26, 1983 [NO] Norway ..... 833449

[51] Int. Cl.[4] ..... B65H 57/28

[52] U.S. Cl. ..... 242/157.1

[58] Field of Search ..... 242/157.1, 157 R, 158 R

[56] References Cited

U.S. PATENT DOCUMENTS

| | | | |
|---|---|---|---|
| 2,336,684 | 12/1943 | Hendrickson | 242/157.1 |
| 2,453,184 | 11/1948 | Berry | 242/157.1 |
| 2,473,628 | 6/1949 | Allison | 242/157.1 |
| 2,546,794 | 3/1951 | Sole | 242/157.1 |

FOREIGN PATENT DOCUMENTS

| | | | |
|---|---|---|---|
| 1025700 | 1/1953 | France | 242/157.1 |
| 2524452 | 10/1983 | France | 242/157.1 |
| 403276 | 8/1977 | Sweden . | |
| 261465 | 8/1949 | Switzerland | 242/157.1 |
| 526862 | 9/1940 | United Kingdom | 242/157.1 |

*Primary Examiner*—Stanley N. Gilreath

*Attorney, Agent, or Firm*—Lucas & Just

[57] ABSTRACT

The present invention relates to a feed device for guiding rope onto a winding drum mounted on a frame 3. The device comprises a first guide pulley 5 which is mounted on the frame 3 between the winding drum 1 and a fixed frame pulley 4, and a second guide pulley 7 which is mounted at the upper end of an arm 6. The arm 6 is pivoted to the frame 3 at its lower end at a point below the first guide pulley 5.

4 Claims, 3 Drawing Figures

I
7
6
2
5
4
1
3
I 7
6
5
1
2

7
2
5
6
4
1
3

FEED DEVICE FOR GUIDING A ROPE ONTO A WINDING DRUM

The present invention relates to a feed device for guiding rope onto winding drums on hoisting apparatus where the drum is mounted on a frame.

Typical hoisting apparatuses comprise winches, cranes, excavators or the like. Particularly, but not exclusively, the present invention is specially suited for winches mounted on tractors.

The hitherto known and used feeding devices for guiding rope onto winding drums on winches comprise mechanical devices that via transmission means are operated syncronically with the rotation speed of the drum. For smaller winches, intended to be used on tractors or the like, these known feeding devices for guiding rope onto a drum, are too complicated and space-consuming, and can therefore not be used. Such winches are therefore usually not equipped with any special device for guiding the rope onto the winding drum. Unfortunately, when the width of the winding drum exceeds a minimum length, it is impossible to wind the rope closely and evenly in layers over the whole length of the drum. Depending on how the fixed frame pulley is placed in the proportion to the drum, the winding of the rope on the drum is concentrated just to a part of the width of the drum as the rope will "climb" uncontrolled upon previous rope layers on the drum. Hence coils on subsequent rope layers will trap themselves in the spaces between coils in previous layers. The trapping of coils between coils in previous layers cause increased wear and thereby a shorter life for the rope. In addition only a part of the capacity of the drum is used.

In British Pat. No. 1.199.916 there is described a device for guiding rope onto winding drums where the rope is guided by a pulley mounted on a pendulum. The pendulum moves in a direction parallel to the axis of rotation of the winding drum. This device makes it possible to use a somewhat longer winding drum than can be used without such a device.

However, that increase in width of the drum which is made possible by the winding device of British Pat. No. 1.199.916 is dependent on the length of the pendulum. For longer winding drums the problem with the rope climbing uncontrolled upon previous rope layers on the drum is still not solved.

These drawbacks and shortcomings are overcome by the feed device according to the present invention. By the feed device according to the present invention, the rope is guided onto the winding drum by utilizing the fact that the force necessary for the rope to climb onto previous coils on the drum is greater than the force necessary to move a pivotally mounted arm which is equipped with at least one guide pulley for the rope.

According to the present invention there is provided a feed device for guiding a rope from a fixed frame pulley onto a winding drum, said device comprising a first guide pulley mounted on the frame between the winding drum and the fixed frame pulley and a second guide pulley which is mounted on the upper end of an arm said arm being pivoted to the frame at its lower end at a point below the first guide pulley. Further features of the present invention will be evident from the claims.

One embodiment of the present invention will now be described with reference to the accompanying drawings in which.

Figure 1:
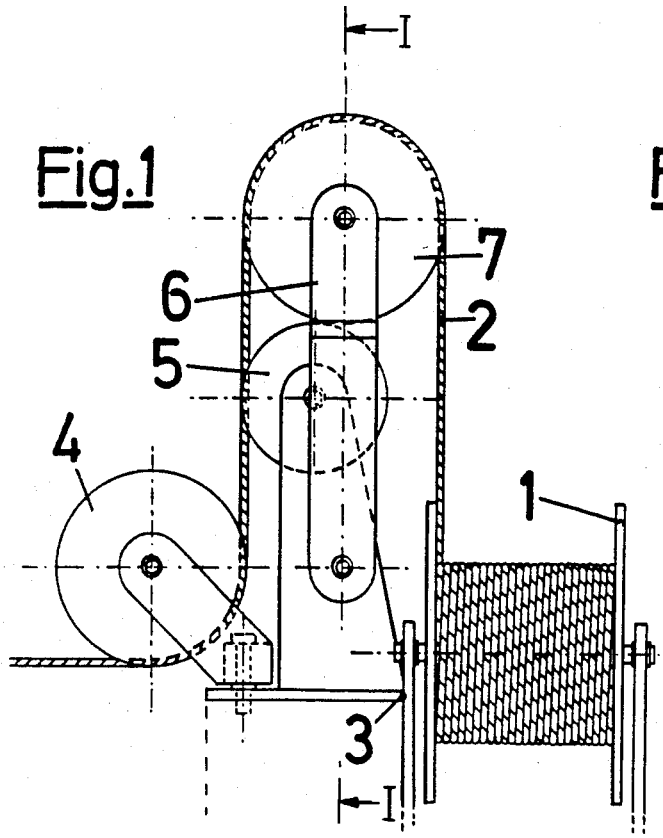
FIG. 1 shows a vertical front elevation of the feed device according to the present invention.

Referring now to the drawings, a winding drum 1 for a winch or the like is shown on which winding drum 1 a rope 2 is to be coiled. The drum 1 is in usual way rotatably mounted on a winch frame 3, and is connected to a conventional driving mechanism for rotation of the drum 1 (not shown). The rope 2 runs over a fixed frame pulley 4. The fixed frame pulley 4 is pivotally mounted so that the winch can be used for different hauling angles.

Figure 3:
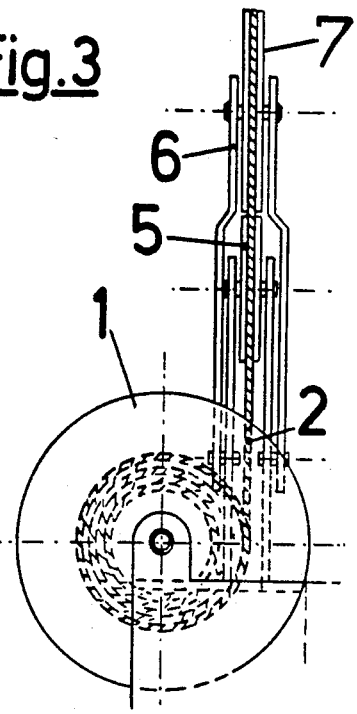
FIG. 3 shows a vertical front elevation taken along line I—I on FIG. 1.
Figure 2:
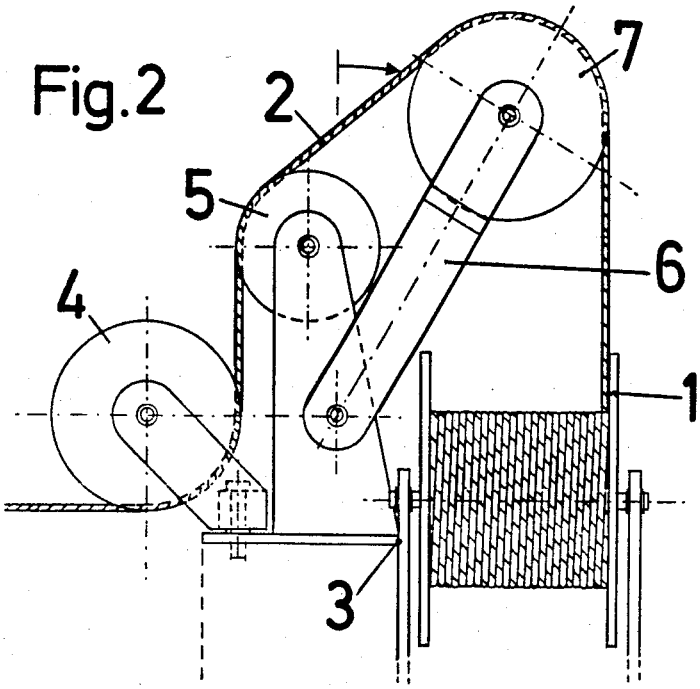
FIG. 2 shows a vertical front elevation of the feed device, but in another position than FIG. 1.

The feed device for guiding the rope onto the drum comprises a first guide pulley 5 which is mounted on the frame 3 between the fixed frame pulley 4 and the drum 1. The first guide pulley 5 is mounted in such a way that its axis of rotation is perpendicular to a vertical plane running parallel to the axis of rotation of the drum 1 (see FIG. 3). The first guide pulley 5 is a guide pulley on which the rope 2 runs over after the fixed frame pulley 4. The diameter and the position on the frame 3 of the first guide pulley 5 are adjusted in such a way that the rope 2 will run vertically between the fixed frame pulley 4 and the first guide pulley 5. This is shown in FIGS. 1 and 2. An arm 6 is at its lower end pivoted to the frame 3 on a point below the first guide pulley 5. The arm 6 is pivoted in such a way that it can swing from a vertical position and along the axis of rotation of the drum 1. At its upper end the arm 6 is equipped with a second guide pulley 7 over which the rope 2 runs before it enters onto the winding drum 1. When the arm 6 is in vertical position, the rope 2 runs in vertical direction between the first guide pulley 5 and the second guide pulley 7.

The length of the arm 6 and the diameter of the second guide pulley 7 are to be adjusted in such way that when the arm 6 is in vertical position, the distance between the fixed frame pulley 4, the first guide pulley 5 and the second guide pulley 7 is as short as possible.

The horizontal distance between the fixed frame pulley 4 and the first guide pulley 5 is preferably not greater than the sum of the bottom radius for the fixed frame pulley 4, the bottom radius of the first guide pulley 5 and the diameter of the rope 2. In this position the diameter of the second guide pulley 7 and the pivoting point for the arm 6 are adjusted in such a way that when the arm 6 is in vertical position, the rope 2 runs over the second frame pulley 7 and on to the end of the drum 1 which is closest to the frame 3. This position of the arm 6 is shown in FIG. 1.

The device according to the present invention operates as described below:

The rope 2 runs over the fixed frame pulley 4, the first guide pulley 5 and the second guide pulley 7 and on to the winding drum 1 as shown in FIG. 1.

If the arm 6 at the start of the winding is in vertical position at an angle of 90° in relation to the axis of the drum and the end of the rope 2 is fastened to the flange of the winding drum 1 which is closest to the frame 3, the winding of the rope 2 will start on the side of the drum which is closest to the frame 3. This position is shown on FIG. 2. When the rope 2 is tightened by rotation of the drum 1, the force necessary for the rope 2 to climb on the previous rope layer is greater than the force necessary to move the arm 6. Hence the arm 6 with the second guide pulley 7 will swing along the axis of rotation of the drum 1.

When the winding of the rope has progressed to the opposite end of the drum 1 the arm 6 has its maximum turning. This position is shown on FIG. 2. By continuing the winding of the rope the arm 6 will now start to swing back toward vertical position again, as the force necessary for the next winding of the rope 2 to climb up onto the preceding winding on the drum 1 still is greater than the force necessary to move the arm 6. The pendulum 6 will thereby start to move back to its vertical position. Consequently, while winding the rope 2 on the drum 1 the arm 6 will move backwards and forwards between the two positions shown on FIG. 1 and FIG. 2 and thereby guide the rope onto the drum 1.

The length of the rope 2 from the fixed frame pulley 4 via the first and second guide pulleys and onto the drum 1, will by the device of the invention always be constant and independent of the position of the arm 6.

I claim:

1. A device for guiding rope comprising:

(a) a frame;

(b) a drum rotatably mounted on said frame for receiving said rope;

(c) a frame pulley mounted on said frame;

(d) a first guide pulley mounted on said frame between, with respect to the movement of said rope, said frame pulley and said drum, and such that said rope runs vertically between said frame pulley and said first guide pulley;

(e) an arm, one end of said arm being pivotally mounted to said frame at a point on said frame below the mounting point of said first guide pulley; and (f) a second guide pulley mounted at the other end of said arm such that the axis of said second guide pulley is substantially perpendicular to a vertical plane which is parallel to the axis of said drum, said second guide pulley guiding said rope on to said drum when said rope is wound onto said drum.

2. Feed device according to claim 1 wherein the axis of rotation of the first guide pulley is perpendicular to a vertical plane which is parallel to the axis of rotation of the winding drum.

3. Feed device according to claim 1 wherein the length of said arm and the diameter of said second guide pulley are such that when said arm is in a vertical position, the vertical distance between said frame pulley, said first guide pulley and said second guide pulley is as short as possible.

4. The device of claim 1 wherein said one end of said arm is pivotally mounted on said frame at a point in the horizontal plane through the axis of said frame pulley.

* * * * *